United States Patent [19]

Somers

[11] 4,045,333

[45] Aug. 30, 1977

[54] AROMATIC PURIFICATION PROCESS

[75] Inventor: Allen E. Somers, Pittsburgh, Pa.

[73] Assignee: Gulf Research & Development Company, Pittsburgh, Pa.

[21] Appl. No.: 653,283

[22] Filed: Jan. 29, 1976

[51] Int. Cl.[2] ..... C10G 19/00; C10G 21/16

[52] U.S. Cl. ..... 208/327; 208/283; 260/674 R; 260/674 SE

[58] Field of Search ..... 208/327, 287, 283; 260/674 R, 674 SE

[56] References Cited

U.S. PATENT DOCUMENTS

| | | | |
|---|---|---|---|
| 1,861,711 | 6/1932 | Moreton | 208/287 |
| 2,034,712 | 3/1936 | Dolbear | 208/287 |
| 2,938,862 | 5/1960 | Annable et al. | 208/283 |
| 3,093,576 | 6/1963 | Campbell | 208/327 |
| 3,457,165 | 7/1969 | Urban | 208/283 |

*Primary Examiner*—Herbert Levine

[57] ABSTRACT

Traces of furfural are removed from an aromatic feed by passing the aromatic feed containing greater than 50 ppm furfural through a bed of solid particles of a selected treating agent.

4 Claims, No Drawings

AROMATIC PURIFICATION PROCESS

BACKGROUND OF THE INVENTION

In the production of lubricating oils solvent extraction processes are employed to separate the aromatic fraction from the more desirable paraffinic fraction. In such processes a solvent which preferentially dissolves aromatic hydrocarbons and which is at least partially immiscible with the charge oil under the conditions of contacting is employed. A suitable solvent is furfural.

After contacting the charge oil with furfural under conventional solvent refining conditions, the resulting furfuralaromatic fraction is then fractionally distilled to separate the furfural which is then recycled to the solvent extraction zone. The aromatic fraction, commonly referred to as an aromatic extract, can be employed in the manufacture of ink oils. Before such aromatic extract can be effectively employed in the ink oils, the concentration of the furfural must be reduced to less than 50 parts per million (ppm). The most efficient of the distillation processes employed in the separation of furfural from the aromatic extract produces an aromatic extract product normally containing greater than 100 ppm furfural.

THE INVENTION

By the invention traces of furfural are removed from aromatic feeds containing greater than 50 ppm furfural by passing the aromatic feed through a bed of solid particles of a treating agent selected from the group consisting of potassium hydroxide and sodium hydroxide under purification conditions so as to obtain an aromatic product containing less than 25 ppm furfural.

DESCRIPTION OF THE INVENTION

The invention is directed to the separation of furfural from aromatic feeds containing greater than 50 ppm furfural. The furfural containing aromatic feed is passed through a particle bed of a treating agent selected from the group consisting of potassium hydroxide and sodium hydroxide. Although not to be limited thereto, it is preferred that the size of the particles of the treating agent be in the range of 10 - 20 mesh or less.

The temperature of the aromatic feed passed through the bed of particles is maintained below 190° F. (88° C.), preferably in the range of 150° to 180° F. (66° to 82° C.). Temperatures above 190° F. (88° C.) result in solvation of the treating agent.

Optimum removal of the trace of furfural from the aromatic feed is obtained when operating at a temperature in the range of 150° to 180° F. (66° to 82° C.), a mass velocity of 700 pounds per hour per square feet or greater, and employing treating agent particles sized in the range of 10 - 20 mesh or less. The aromatic purification process is preferably conducted at ambient pressure.

The invention will hereafter be described as it relates to the purification of the aromatic extract obtained from a medium lube oil distillate feed. A waxy lube oil distillate as characterized in the following Table I, is countercurrently contacted in a rotary disc contactor at ambient pressure with furfural employing a solvent to oil ratio on a volume basis, of 2.1 to 1. A top temperature of 222° F. (106° C.) and a bottom temperature of 150° F. (66° C.) is maintained in the contactor.

Based on the feed, the raffinate separated from the furfural and aromatic extract comprises 63.6 percent. After separation of the furfural from the aromatic extract by fractional distillation, the aromatic extract comprises 36.4 volume percent, based upon the feed. The aromatic extract and raffinate fractions have the properties set forth below in Table I:

TABLE I

| | Charge Oil | | Aromatic Extract | | Raffinate | |
|---|---|---|---|---|---|---|
| Gravity, °API | 20.4 | | 9.1 | | 29.7 | |
| Viscosity, SUS at 100° F. (38° C) | 530 | | 3,914 | | 250 | |
| Viscosity, SUS at 210° F. (99° C) | 60.8 | | 107.1 | | 51.0 | |
| Viscosity Index | 75 | | — | | 112 | |
| Flash Point, ° F. | — | | 460 | (238° C) | — | |
| Pour Point, ° F. | +95 | (+35° C) | +65 | (+18° C) | +100 | (+38° C) |
| Sulfur, Wt. % | 2.92 | | 5.40 | | 0.94 | |
| Carbon Residue, Wt. % | .80 | | 1.96 | | .16 | |
| Furfural, ppm | | | 100 | | | |

The aromatic extract of Table I is passed downwardly through a bed of solid sodium hydroxide particles with the temperature of the contact zone maintained at 150° F. (66° C.). The average particle size of the bed is 0.0559 inches, 1.42 mm with the largest particle size being 0.0787 inches, 2.0 mm. The aromatic extract is passed through the bed at a mass velocity of 760 lbs/hr/ft$^2$ and the contact zone is operated at atmospheric pressure.

Analysis of the aromatic extract product withdrawn from the contact zone indicates that the concentration of furfural is less than 10 ppm. Typically, it has been observed that the furfural content of aromatic extracts can be reduced from, for example, 130 ppm to 10 ppm or less on a continuous basis by passing the extracts over a packed bed of granular sodium or potassium hydroxide in a single pass operation.

Although the invention has been described with reference to specific embodiments, references, and details, various modifications and changes will be apparent to one skilled in the art and are contemplated to be embraced in this invention.

I claim:

1. A process which comprises passing an aromatic feed containing greater than 50 ppm furfural through a solid bed of particles of a treating agent selected from the group consisting of sodium hydroxide and potassium hydroxide, and recovering therefrom an aromatic product containing less than 25 ppm furfural.

2. The process of claim 1 wherein the aromatic feed passed through the solid bed of particles is maintained at a temperature in the range of 150° to 190° F.

3. The process of claim 2 wherein the mass velocity of said aromatic feed passed through said bed is maintained at 700 pounds per hour per square feet or greater and wherein the size of the particles is in the range from 10 - 20 mesh or less.

4. A process which comprises contacting a lube oil charge containing an aromatic fraction with furfural under aromatic extraction conditions, recovering therefrom furfural containing an aromatic extract, separating furfural from said aromatic extract by distillation, thereafter passing the seperated aromatic extraction containing greater than 50 ppm of furfural through a solid bed of particles of a treating agent selected from the group consisting of sodium hydroxide and potassium hydroxide, and recovering therefrom an aromatic extract containing less than 25 ppm furfural.

* * * * *